US009115581B2

(12) United States Patent
Knuth et al.

(10) Patent No.: US 9,115,581 B2
(45) Date of Patent: Aug. 25, 2015

(54) SYSTEM AND METHOD OF VECTOR DRIVE CONTROL FOR A MINING MACHINE

(71) Applicant: Harnischfeger Technologies, Inc., Wilmington, DE (US)

(72) Inventors: Jason Knuth, Brookfield, WI (US); Wesley P. Taylor, Glendale, WI (US); Mooyoung Lee, Milwaukee, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 14/327,324

(22) Filed: Jul. 9, 2014

(65) Prior Publication Data

US 2015/0019087 A1 Jan. 15, 2015

Related U.S. Application Data

(60) Provisional application No. 61/844,236, filed on Jul. 9, 2013.

(51) Int. Cl.

| | |
|---|---|
| ***E02F 9/20*** | (2006.01) |
| ***E21C 35/24*** | (2006.01) |
| ***E02F 9/26*** | (2006.01) |
| *E02F 3/30* | (2006.01) |
| *E02F 3/43* | (2006.01) |

(52) U.S. Cl.

CPC ..... *E21C 35/24* (2013.01); *E02F 3/437* (2013.01); *E02F 9/2029* (2013.01); *E02F 9/265* (2013.01); *E02F 3/304* (2013.01); *E02F 3/435* (2013.01)

(58) Field of Classification Search

CPC ..... E21C 35/24; E02F 9/265; E02F 9/2029; E02F 3/437; E02F 3/304; E02F 3/435

See application file for complete search history.

(56) References Cited

U.S. PATENT DOCUMENTS

| | | | | |
|---|---|---|---|---|
| 3,586,184 | A * | 6/1971 | Pesavento et al. | 414/685 |
| 4,263,535 | A * | 4/1981 | Jones | 318/87 |
| 5,408,767 | A * | 4/1995 | Hazama et al. | 37/396 |
| 5,752,333 | A | 5/1998 | Nakagawa et al. | |
| 5,835,874 | A | 11/1998 | Hirata et al. | |
| 5,960,378 | A | 9/1999 | Watanabe et al. | |
| 5,974,352 | A | 10/1999 | Shull | |
| 6,025,686 | A | 2/2000 | Wickert et al. | |

(Continued)

FOREIGN PATENT DOCUMENTS

| | | | |
|---|---|---|---|
| JP | 6286235 | A | 4/1987 |
| JP | 2002167794 | A | 6/2002 |
| WO | WO2012/148437 | * | 11/2012 |

*Primary Examiner* — Michael J Zanelli

(74) *Attorney, Agent, or Firm* — Michael Best & Friedrich LLP

(57) ABSTRACT

Controlling a digging operation of an industrial machine. The industrial machine includes a dipper, a crowd motor, and a hoist motor. The control includes determining a torque associated with the crowd motor and a torque associated with the hoist motor and determining a dig force vector for the dipper based on the torque associated with the crowd motor and the torque associated with the hoist motor. The dig force vector includes a dig force angle and a dig force magnitude. The method also includes determining a value for the dig force angle of the dig force vector, and controlling, using a processor, the dig force magnitude based on the determined value for the dig force angle. The dig force magnitude is controlled by controlling at least one of the torque associated with the crowd motor and the torque associated with the hoist motor.

23 Claims, 7 Drawing Sheets

(56) References Cited

U.S. PATENT DOCUMENTS

| | | | | |
|---|---|---|---|---|
| 6,098,322 | A | 8/2000 | Tozawa et al. | |
| 6,101,437 | A | 8/2000 | Oshina et al. | |
| 6,205,687 | B1 * | 3/2001 | Rocke | 37/348 |
| 7,007,415 | B2 | 3/2006 | Koch | |
| 7,516,563 | B2 | 4/2009 | Koch | |
| 7,539,570 | B2 | 5/2009 | Normann | |
| 7,810,260 | B2 | 10/2010 | Pope et al. | |
| 7,949,449 | B2 | 5/2011 | Koch et al. | |
| 8,065,037 | B2 | 11/2011 | Danko | |
| 8,145,394 | B2 | 3/2012 | Chiorean et al. | |
| 8,261,471 | B2 | 9/2012 | Hall et al. | |
| 8,515,708 | B2 | 8/2013 | McAree et al. | |
| 8,571,762 | B2 | 10/2013 | McAree et al. | |
| 8,571,766 | B2 | 10/2013 | Colwell et al. | |
| 8,577,564 | B2 | 11/2013 | Stanek | |
| 2012/0165962 | A1 | 6/2012 | Faivre | |
| 2012/0232763 | A1 | 9/2012 | Mizuochi et al. | |
| 2014/0019014 | A1 * | 1/2014 | Claxton | 701/50 |

* cited by examiner

SYSTEM AND METHOD OF VECTOR DRIVE CONTROL FOR A MINING MACHINE

RELATED APPLICATIONS

This application claims the benefit of U.S. Provisional Patent Application No. 61/844,236, filed Jul. 9, 2013, the entire content of which is hereby incorporated by reference.

BACKGROUND

The present invention relates to drive control for electric mining shovels.

SUMMARY

Industrial machines, such as electric rope or power shovels, draglines, backhoes, etc., are used to execute operations, for example, digging to remove material from a bank of a mine. These machines and/or their components are generally driven by actuator(s), such as but not limited to, electric motors, hydraulic systems, etc.

These machines operate in predictable cycles, which include various operations within the cycles (e.g., a dig preparation operation, a dig operation, etc.). During the machine operations, various attachments of the machines (e.g., a dipper of a mining shovel) exert forces, in the form of force vectors. A force vector includes a force magnitude and a force direction (i.e., a force angle). One such force vector is a dig force vector, which is exerted by the attachment of the machine during the dig operation. The dig force vector comprises a dig force magnitude and a dig force angle. In one embodiment, the dig force angle is referenced to any designated point of the machine, including but not limited to, the rotational centerline of the mining machine or the ground.

In one embodiment, the invention provides a method of controlling a digging operation of an industrial machine. Controlling the digging operation of an industrial machine includes promoting an efficient dig force vector. Efficient dig force vectors improve digging performance and improve the structural life of the industrial machine. Digging performance is improved by maximizing the dig force magnitude with minimal impact to the structural components of the machine.

During the dig preparation operation and the ensuing digging operation, the dig force vector may be controlled, via a controller of the industrial machine implementing vector drive control. Vector drive control enhances the digging performance of the mining machine by optimizing the digging force exerted by the industrial machine. In one embodiment, the vector control system controls the dig force vector by controlling the torque limits of the actuators (e.g., motors) of the industrial machine. In another embodiment, the vector control system controls the dig force vector by directly controlling the force of the various actuators (e.g., torque of the motors, pressure of a hydraulic system, etc.) of the industrial machine.

For example, a mining machine includes a plurality of motors. The motors include, but are not limited to, hoist motors and crowd motors. The motors of the mining machine typically follow characteristics of a fixed torque and speed curve. The torque limit of a motor is determined from the capabilities of the specific motor, along with a determined stall force of the mining machine. The vector control system controls/alters the torque of the hoist and crowd motors during hoist and crowd operations. In one embodiment, the vector control system controls the torque by altering the torque limits of the motors. The torque limits of the motor are altered by decreasing or increasing the torque limits above or below the traditional fixed torque limits. Increasing the torque limit beyond the traditional fixed torque limit allows for a dig force magnitude which is greater than normal, while decreasing the torque limit below the traditional fixed torque limit restricts a dig force magnitude. In another embodiment, the vector control system directly controls the torque of the various motors to achieve the optimal force magnitude and force angle. In another embodiment, the vector control system alters a torque maximum and a torque minimum, in order to maintain the torque within an upper limit and a lower limit.

As discussed above, the vector control system dynamically controls the torque of the hoist motors and/or the crowd motors, in order to control the dig force vector. In some embodiments, the torque limits, and thus the dig force vector, are altered based on various characteristics. The characteristics include, but are not limited to, the position of the attachment, the dynamic forces exerted by the attachment, and operator reference.

The position of the attachment is known by tracking the position and angle of a point on the attachment. For example, in one embodiment, by tracking the position and angle of an engagement point (e.g., dipper teeth of a dipper (the attachment), dipper lip of a dipper, etc.), the position of the attachment is known. With a known attachment position, the position of the handle and hoist angles with respect to a designated point of the machine can be calculated.

The dynamic forces on the dipper during motion are known via the main control system. The main control system includes a plurality of sensors, including torque and acceleration sensors, located on various components of the mining machine. The sensors sense, among other things, torque values (e.g., hoist torque, crowd torque, etc.), acceleration values (e.g., hoist acceleration, crowd acceleration, etc.), speed values (e.g., hoist speed, crowd speed, etc.), and position (e.g., hoist position, crowd position, etc.). These sensed values may be used to determine the dynamic forces on the dipper during motion.

The vector control system further controls the dig force vector based upon the angle of the dig force vector approaching a lower boundary angle or an upper boundary angle. In general, as the dig force angle approaches the upper boundary angle, the hoist torque limit will be reduced. As the dig force angle approaches the lower boundary angle, the crowd torque limit will be reduced. The boundary limit angles can be fixed, or can dynamically change depending on dipper position. For example, but not limited to a mining machine, when the engagement point of the dipper (e.g., dipper teeth, dipper lip, etc.) is penetrating a toe of a bank of mining material, during the dig operation, the lower boundary may be at an angle that discourages boom jacking. When the dipper is cutting up the bank during the dig operation, the lower and upper boundaries will be at an angle to encourage the dig force vector to be slightly less than vertical. Controlling the dig force vector at an angle slightly less than vertical allows an increase in a dig force magnitude, without stalling the hoist motors. Additionally, the lower and upper boundary angles may have associated "buffer" vectors that are located within the lower and upper boundary angles. The buffer vectors prevent the overshooting of the dig force vector beyond the lower and upper boundary angles. In some embodiments, the angle of the buffer vectors are dependent on the response time of the control system.

In general, a dig force vector which is relatively in line with the teeth angle is the most energy efficient. In other words, such a dig force vector requires the least amount of energy output from the machine or shovel to move the dipper through the bank of material. However, such a dig force vector is not always possible to maintain. In those situations, during initial penetration of the bank, a dig force vector along or in-between the dipper teeth angle and the lower boundary angle is effected to inspire productive digging while still requiring relatively little amount of energy output from the machine. During the hoist of the dipper through the face of the bank, a dig force vector between the upper boundary angle and the dipper teeth angle is effective to inspire productive digging while still requiring relatively little amount of energy output from the machine. In some embodiments, vector control will only be active when operator references are trying to advance the dipper towards the bank, but this is not limiting, this theory could further be applied for autonomous operation.

Benefits of vector control include, but are not limited to, maximizing dig force and efficiency while improving or maintaining the structural life of the machine and improving operation for inexperienced operators. The dig force is maximized while improving the structural life of the machine by using maximum torque limits of the motors of the machine while preventing events such as boom-jacking (i.e., when hoist cables become slacked followed by a quick tightening) and tipping (i.e., when the machine tips over), which decrease the structural life of the machine, and motor stalling (i.e., the condition when a motor stops rotating, but still provides torque), which prevents digging optimization. Vector control improves operation for inexperienced operators by promoting an efficient dig force angle during dig operations along with minimizing abusive operation by the operator, such as but not limited to, boom-jacking.

In one embodiment, the invention provides a method of controlling a digging operation of an industrial machine. The industrial machine includes a dipper, a crowd motor, and a hoist motor. The method includes determining a torque associated with the crowd motor and a torque associated with the hoist motor, and determining a dig force vector for the dipper based on the torque associated with the crowd motor and the torque associated with the hoist motor. The dig force vector includes a dig force angle and a dig force magnitude. The method also includes determining a value for the dig force angle of the dig force vector, and controlling, using a processor, the dig force magnitude based on the determined value for the dig force angle. The dig force magnitude is controlled by controlling at least one of the torque associated with the crowd motor and the torque associated with the hoist motor.

In another embodiment, the invention provides an industrial machine that includes a dipper, a crowd drive, a hoist drive, and a controller. The crowd drive is configured to provide one or more control signals to a crowd motor. The crowd motor is operable to provide a force to the dipper to move the dipper. The hoist drive is configured to provide one or more control signals to a hoist motor. The hoist motor is operable to provide a force to the dipper to move the dipper. The controller includes a processor and is connected to the crowd drive and the hoist drive. The controller is configured to determine a torque of the crowd motor and a torque of the hoist motor, and determine a dig force vector for the dipper based on the torque of the crowd motor and the torque of the hoist motor. The dig force vector includes a dig force angle and a dig force magnitude. The controller is also configured to determine a value for the dig force angle of the dig force vector, and control the dig force magnitude based on the determined value for the dig force angle. The dig force magnitude is controlled by controlling at least one of a torque of the crowd motor and a torque of the hoist motor.

In another embodiment, the invention provides a method of controlling a digging operation of an industrial machine. The industrial machine includes a dipper, a crowd actuator, and a hoist actuator. The method includes determining a force associated with the crowd actuator and a force associated with the hoist actuator, and determining a dig force vector for the dipper based on the force associated with the crowd actuator and the force associated with the hoist actuator. The dig force vector includes a dig force angle and a dig force magnitude. The method also includes determining a characteristic of the industrial machine, and controlling, using a processor, the dig force vector based on the characteristic of the industrial machine. The dig force vector is controlled by controlling at least one of the force associated with the crowd actuator, the force associated with the hoist actuator, and an angle of the dipper.

Other aspects of the invention will become apparent by consideration of the detailed description and accompanying drawings.

DETAILED DESCRIPTION

Figure 1:
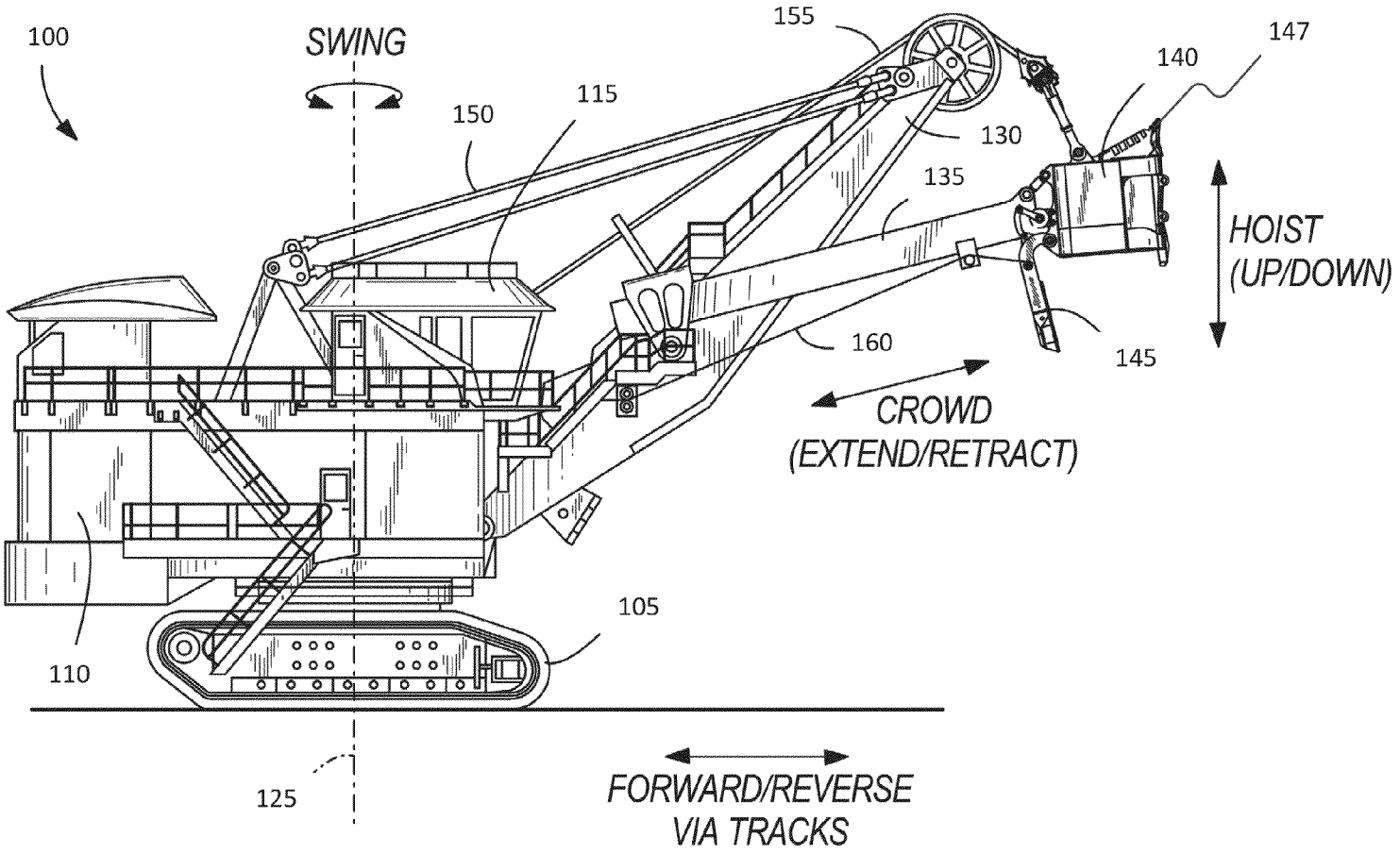
FIG. 1 illustrates a mining machine according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

Although the invention described herein can be applied to, performed by, or used in conjunction with a variety of industrial machines (e.g., a rope shovel, a dragline with hoist and drag motions, hydraulic machines, backhoes, etc.), embodiments of the invention described herein are described with respect to an electric rope or power shovel, such as the mining shovel illustrated in FIG. 1. The embodiment shown in FIG. 1 illustrates the electric mining shovel 100 as a rope shovel, however in other embodiments the electric mining shovel 100 can be a different type of mining machine, for example, a hybrid mining shovel, a dragline excavator, etc. The mining shovel 100 includes tracks 105 for propelling the mining shovel 100 forward and backward, and for turning the mining shovel 100 (i.e., by varying the speed and/or direction of the left and right tracks relative to each other). The tracks 105 support a base 110 including a cab 115. The base 110 is able to swing or swivel about a swing axis 125, for instance, to move from a digging location to a dumping location. Movement of the tracks 105 is not necessary for the swing motion. The mining shovel 100 further includes a boom 130 supporting a pivotable handle 135 (handle 135) and an attachment. In one embodiment, the attachment is a dipper 140. The dipper 140 includes a door 145 for dumping contents from within the dipper 140 into a dump location, such as a hopper, dump-truck, or haulage vehicle. The dipper 140 further includes dipper teeth 147 for digging into a bank of the digging location. It is to be understood that various industrial machines may have various attachments (e.g., a backhoe having a scoop, an excavator having a bucket, a loader having a bucket, etc.). Although various embodiment described within discuss the use of the dipper 140 of the mining shovel 100, any attachment of an industrial machine may be used in conjunction with the invention as described.

The mining shovel 100 also includes taut suspension cables 150 coupled between the base 110 and boom 130 for supporting the boom 130; one or more hoist cables 155 attached to a winch (not shown) within the base 110 for winding the cable 155 to raise and lower the dipper 140; and a dipper door cable 160 attached to another winch (not shown) for opening the door 145 of the dipper 140.

The dipper 140 is operable to move based on three control actions: hoist, crowd, and swing. The hoist control raises and lowers the dipper 140 by winding and unwinding hoist cable 155. The crowd control extends and retracts the position of the handle 135 and dipper 140. In one embodiment, the handle 135 and dipper 140 are crowded by using a rack and pinion system. In another embodiment, the handle 135 and dipper 140 are crowded using a hydraulic drive system. The swing control rotates the base 110 relative to the tracks 105 about the swing axis 125. In some embodiments, the dipper 140 is rotatable or tiltable with respect to the handle 135 to various dipper angles. In other embodiments, the dipper 140 includes an angle that is fixed with respect to, for example, the handle 135.

Figure 2:
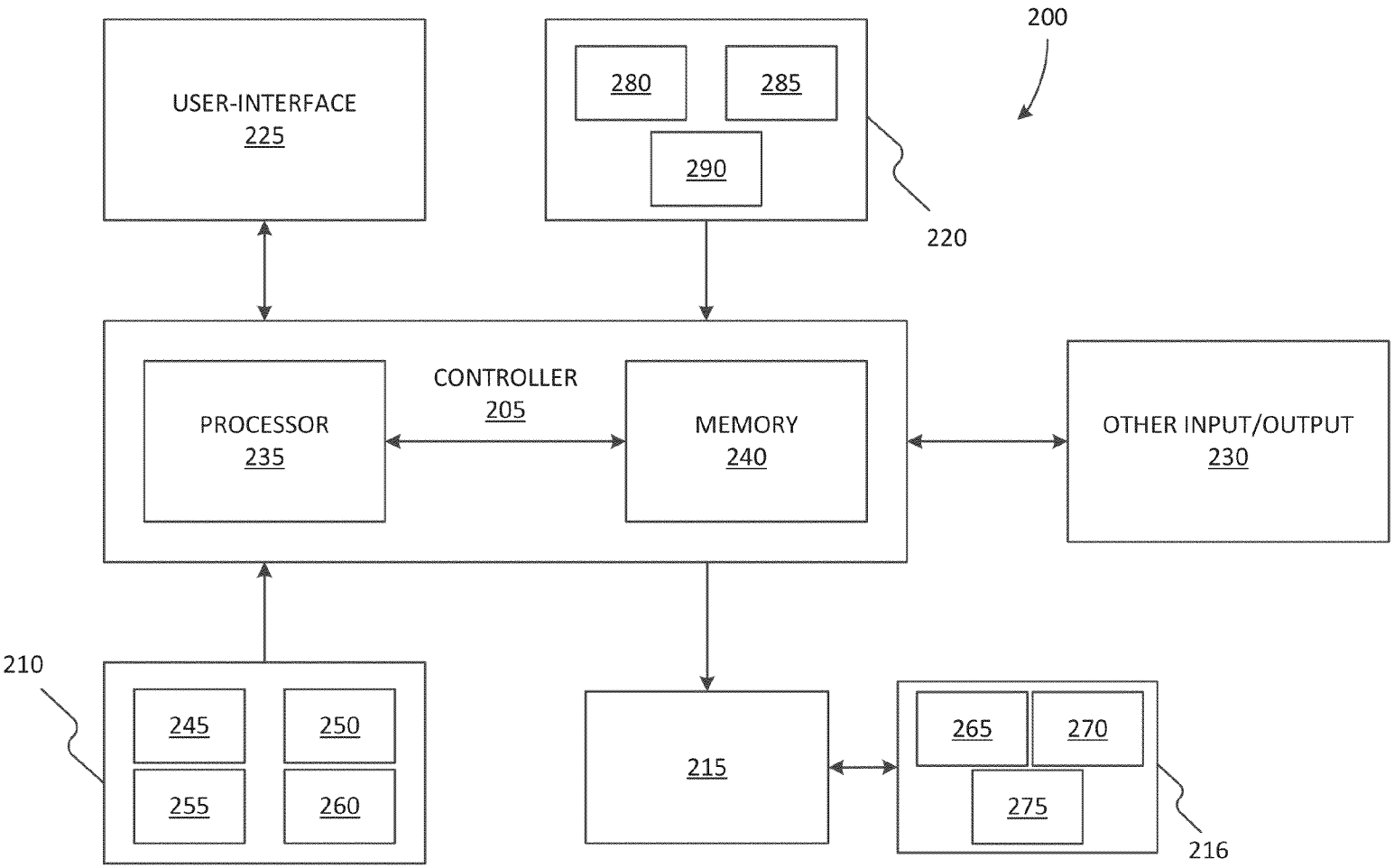
FIG. 2 is a block diagram of a control system of the mining machine of FIG. 1.

As shown in FIG. 2, the mining shovel 100 of FIG. 1 includes a control system 200. It is to be understood that the control system 200 can be used in a variety of industrial machines besides the mining shovel 200 (e.g., a dragline, hydraulic machines, constructions machines, backhoes, etc.) The control system 200 includes a controller 205, operator controls 210, dipper controls 215, sensors 220, a user-interface 225, and other input/outputs 230. The controller 205 includes a processor 235 and memory 240. The memory 240 stores instructions executable by the processor 235 and various inputs/outputs for, e.g., allowing communication between the controller 205 and the operator or between the controller 205 and sensors 220. In some instances, the controller 205 includes one or more of a microprocessor, digital signal processor (DSP), field programmable gate array (FPGA), application specific integrated circuit (ASIC), or the like.

The controller 205 receives input from the operator controls 210. The operator controls 210 include a crowd control or drive 245, a swing control or drive 250, a hoist control or drive 255, and a door control 260. The crowd control 245, swing control 250, hoist control 255, and door control 260 include, for instance, operator controlled input devices such as joysticks, levers, foot pedals, and other actuators. The operator controls 210 receive operator input via the input devices and output digital motion commands to the controller 205. The motion commands include, for example, hoist up, hoist down, crowd extend, crowd retract, swing clockwise, swing counterclockwise, dipper door release, left track forward, left track reverse, right track forward, and right track reverse.

Upon receiving a motion command, the controller 205 generally controls dipper controls 215 as commanded by the operator. The dipper controls 215 control a plurality of motors 216 of the mining shovel 100. The plurality of motors 216 include, but are not limited to, one or more crowd motors 265, one or more swing motors 270, and one or more hoist motors 275. For instance, if the operator indicates, via swing control 250, to rotate the base 110 counterclockwise, the controller 205 will generally control the swing motor 270 to rotate the base 110 counterclockwise. However, in some embodiments of the invention the controller 205 is operable to limit the operator motion commands and generate motion commands independent of the operator input.

The controller 205 is also in communication with a number of sensors 220. For example, the controller 205 is in communication with one or more crowd sensors 280, one or more swing sensors 285, and one or more hoist sensors 290. The crowd sensors 280 sense physical characteristics related to the crowding motion of the mining machine and convert the sensed physical characteristics to data or electronic signals to be transmitted to the controller 205. The crowd sensors 280 include for example, a plurality of position sensors, a plurality of speed sensors, a plurality of acceleration sensors, and a plurality of torque sensors. The plurality of position sensors, indicate to the controller 205 the level of extension or retraction of the dipper 140. The plurality of speed sensors, indicate to the controller 205 the speed of the extension or retraction of the dipper 140. The plurality of acceleration sensors, indicate to the controller 205 the acceleration of the extension or retraction of the dipper 140. The plurality of torque sensors, indicate to the controller 205 the amount of torque generated by the extension or refraction of the dipper 140.

The swing sensors 285 sense physical characteristics related to the swinging motion of the mining machine and convert the sensed physical characteristics to data or electronic signals to be transmitted to the controller 205. The swing sensors 285 include for example, a plurality of position sensors, a plurality of speed sensors, a plurality of acceleration sensors, and a plurality of torque sensors. The position sensors indicate to the controller 205 the swing angle of the base 110 relative to the tracks 105 about the swing axis 125, while the speed sensors indicate swing speed, the acceleration sensors indicate swing acceleration, and the torque sensors indicate the torque generated by the swing motion.

The hoist sensors 290 sense physical characteristics related to the swinging motion of the mining machine and convert the sensed physical characteristics to data or electronic signals to be transmitted to the controller 205. The hoist sensors 290 include for example, a plurality of position sensors, a plurality of speed sensors, a plurality of acceleration sensors, and a plurality of torque sensors. The position sensors indicate to the controller 205 the height of the dipper 140 based on the hoist cable 155 position, while the speed sensors indicate hoist speed, the acceleration sensors indicate hoist acceleration and the torque sensors indicate the torque generated by the hoist motion. In some embodiments, the accelerometer sensors, the swing sensors 285, and the hoist sensors 290, are vibration sensors, which may include a piezoelectric material. In some embodiments, the sensors 220 further include door latch sensors which, among other things, indicate whether the dipper door 145 is open or closed and measure weight of a load contained in the dipper 140. In some embodiments, one or more of the position sensors, the speed sensors, the acceleration sensors, and the torque sensors are incorporated directly into the motors 216, and sense various characteristics of the motor (e.g., a motor voltage, a motor current, a motor power, a motor power factor, etc.) in order to determine acceleration.

The user-interface 225 provides information to the operator about the status of the mining shovel 100 and other systems communicating with the mining shovel 100. The user-interface 225 includes one or more of the following: a display (e.g. a liquid crystal display (LCD)); one or more light emitting diodes (LEDs) or other illumination devices; a heads-up display (e.g., projected on a window of the cab 115); speakers for audible feedback (e.g., beeps, spoken messages, etc.); tactile feedback devices such as vibration devices that cause vibration of the operator's seat or operator controls 210; or other feedback devices.

The motors 216 can be any actuator that applies a force. In some embodiments, the motors 216 are alternating-current motors. In some embodiments, the motors 216 are alternating-current synchronous motors. In other embodiments, the motors 216 are alternating-current induction motors. In other embodiments, the motors 216 are direct-current motors. In some embodiments, the motors 216 are commutator direct-current motors (e.g., permanent-magnet direct-current motors, wound field direct-current motors, etc.). In some embodiments, the motors 216 are switch reluctance motors or other types of reluctance motors. In yet another embodiment, the motors 216 are hydraulic motors. In some embodiments, the motors 216 are linear hydraulic motors (i.e., hydraulic cylinders). In another embodiment, the motors 216 are radial piston hydraulic motors. In some embodiment, the motors 216 are torque-controlled motors. In other embodiments, the motors 216 are speed-controlled motors. In yet another embodiment, the motors 216 are a combination of any type of motor discussed above. In some embodiments, the motors 216 follow the characteristics of a fixed torque speed curve. Torque limits for the motors 216 are determined from the capabilities of the individual motors, along with the required stall force of the mining shovel 100.

Figure 3A:
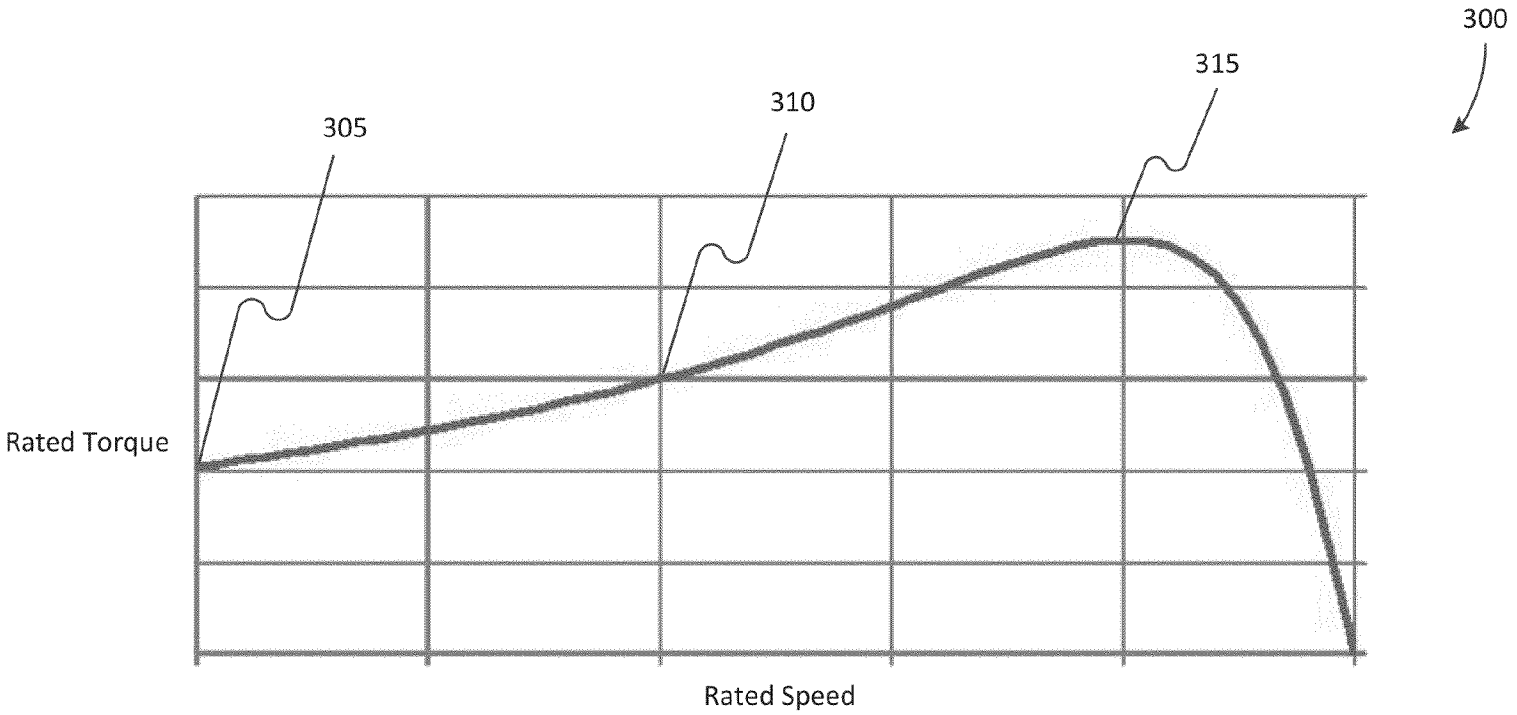
FIGS. 3A and 3B illustrate fixed torque speed curves for a motor of the mining machine of FIG. 1.

FIG. 3A illustrates an example fixed torque speed curve 300 for a motor 216. Starting torque 305 is produced by the motor 216 at startup. Pull-up torque 310 is the minimum torque generated by the motor 216 as the motor 216 accelerates to the operating speed. As illustrated the pull-up torque 310 increases as the speed of the motor 216 is increased. Breakdown torque 315 is the maximum amount of torque that the motor 216 can attain (i.e., the torque of the motor 216 is capped at the breakdown torque). In some embodiments, when vector control is enabled, the controller 205 a torque of a motor 216 is adjusted by dynamically adjusting the breakdown torque 315 of the individual motor 216.

Figure 3B:
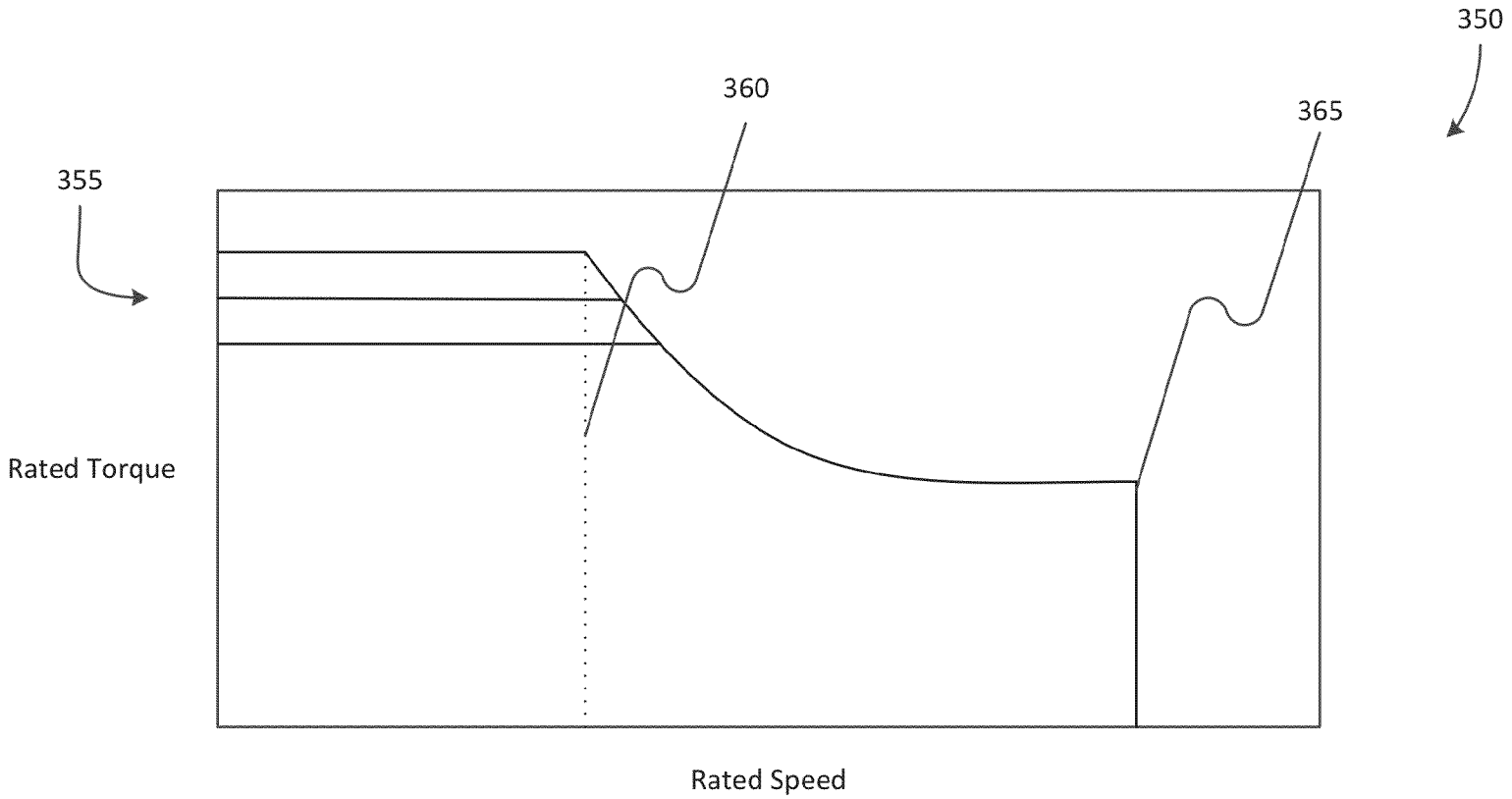

FIG. 3B illustrates another example fixed torque speed curve 350 for a motor 216. A starting torque 355 is produced by the motor 216 at startup. In the illustrated embodiment, when vector control is enabled, the controller 205 adjusts the torque of the motor 216 by varying the starting torque 355. Although only three starting torques 355 are illustrated in FIG. 3B, in some embodiments, when vector control is enabled, the starting torque 355 can be varied indefinitely between a minimum torque and a maximum torque. Once the motor 216 reaches normal speed 360, the torque of the motor 216 begins to decrease. Once the torque of the motor 216 begins to decrease, the motor 216 outputs a constant horsepower. Upon reaching the maximum speed 365, the torque of the motor 216 remains at a level necessary to maintain the maximum speed 365.

In some embodiments, when vector control is enabled, the controller 205 dynamically adjusts the torques by adjusting the torque limits of the motors 216. In another embodiment, when vector control is enabled, the controller 205 directly controls the torques of the motors 216. In yet another embodiment, when vector control is enabled, the controller 205 alters a torque maximum and a torque minimum for the motors 216, thereby narrowing and expanding the operating torque limits of the motors 216. For example, but not limited to, when the dipper 140 approaches the bank of mining material, the torque limits are expanded, and as the dipper 140 traverses up the bank of the mining material, the torque limits are narrowed.

In some embodiments, during the dig preparation operation and the ensuing dig operation, vector control over the motors 216 will be enabled in order to enhance the digging performance and extend the structural life of the mining shovel 100. The torque limits are adjusted in order to control a dig force vector (i.e., a dig force magnitude and a dig force angle). In some embodiments, the torque limits, and thus the dig force vector, are altered based on various characteristics. The characteristics include, but are not limited to, the position of the attachment, the dynamic forces exerted on the attachment, operator reference, and the structural limitations of the specific machine.

The position of the attachment is known by tracking the position and angle of a point on the attachment, which is sensed by the sensors 220. For example, in some embodiments, the position of the dipper 140 is known by tracking the position and angle of a known point on the dipper 140, such as an engagement point (e.g., the dipper teeth 147, a dipper lip, etc.), that engages the bank of the mining material. The position and angle of the known point on the attachment (e.g., the dipper teeth 147, the dipper lip, etc.) is relative to the mining shovel's 100 rotational centerline (swing axis 125), the ground, or another known point of the mining shovel 100. The position and angle of the known point on the attachment (e.g., the dipper teeth 147, the dipper lip, etc.) can then be used to calculate the position of the handle 135 and hoist rope 155 angles.

Figure 4:
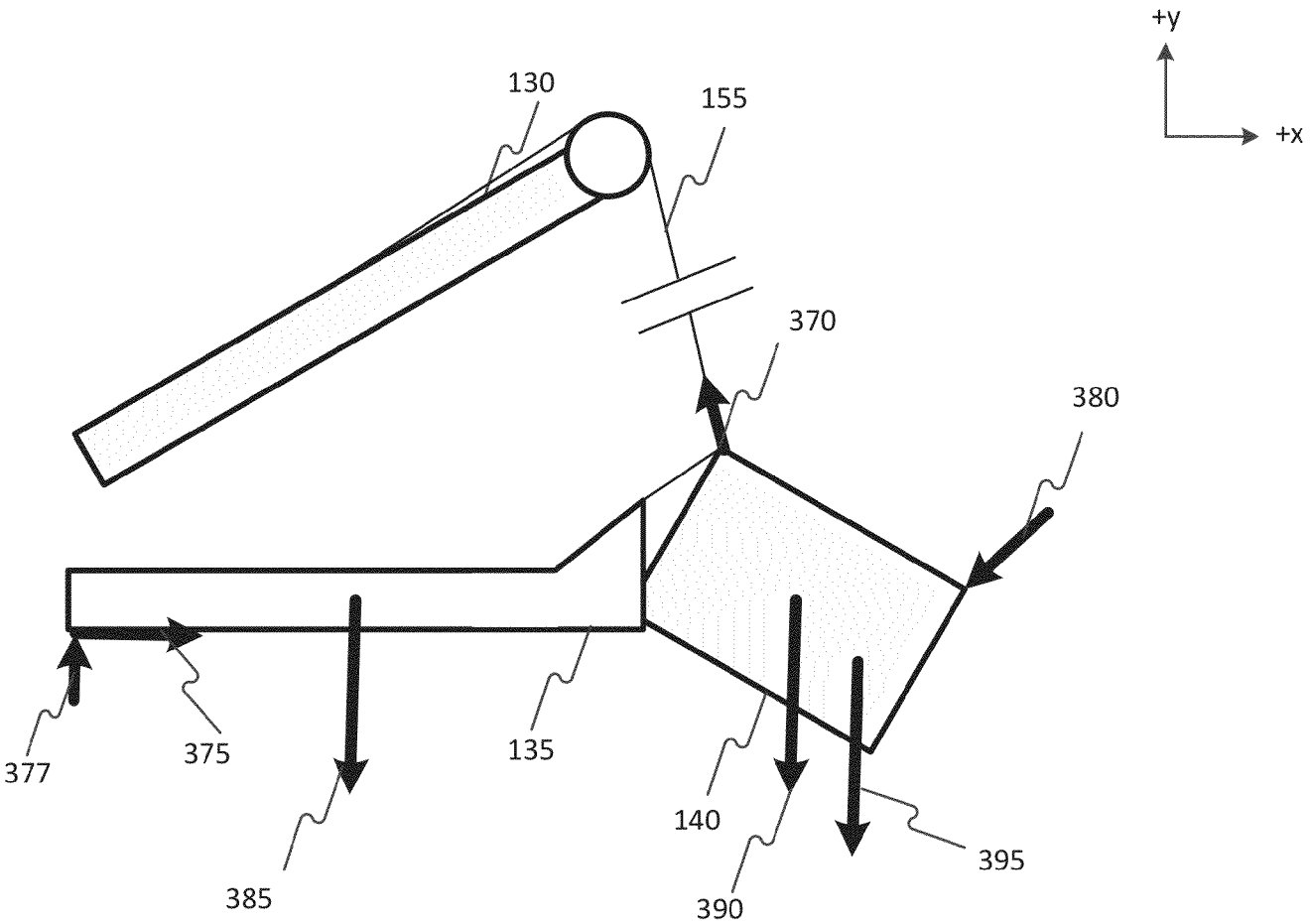
FIG. 4 illustrates forces placed on a dipper, a handle, and a boom during a dig operation of the mining machine of FIG. 1.

FIG. 4 illustrates an exemplary force diagram of the mining machine 100 including the dipper 140, the handle 135, and the boom 130, according to one embodiment of the invention. There may be more or less forces placed on the mining machine 100 than illustrated in FIG. 4. A hoist force 370 is a result of the hoist cables 155 raising the dipper 140. A crowd force 375 is a result of the handle 135 crowding the dipper 140 in an outward direction. A shipper shaft force 377 is a result of the normal force from the handle 135 on a shipper shaft of the boom 130. A dig operation force 380 is the force placed on the engagement point of the dipper 140 as a result of digging through a mining bank. A handle gravity force (HG) 385 is the result of gravity on the handle 135. A dipper gravity (DG) force 390 is the result of gravity on the dipper 140. A material gravity (MG) force 395 is a result of gravity on the mining material within the dipper 140. The dynamic force on the dipper 140 is a result of all of the forces placed on the dipper, as shown in the equations for force in the x-direction ($\Sigma$ $Force_x$), force in the y-direction ($\Sigma$ $Force_y$), and the moment about the shipper shaft ($\Sigma$ Shipper Shaft Moment).

$$\Sigma Force_x = Crowd_x + Hoist_x + ShipperShaft_x + DigOp_x = 0$$

$$\Sigma Force_y = Crowd_y + Hoist_y + ShipperShaft_y + DigOp_y + HG + DG + MG = 0$$

$$\Sigma \text{Shipper Shaft Moment} = Crowd_x(dis_y) + Crowd_y(dis_x) + Hoist_x(dis_y) + Hoist_y(dis_x) + ShipperShaft_x(dis_y) + ShipperShaft_y(dis_x) + DigOp_x(dig_y) + DigOp_y(dis_x) + HG(HG_x) + DG(DG_x) + MG(MG_x) = 0$$

Using the equations above, along with known forces, the dig operation force 380 can be calculated. The known forces (e.g., the hoist force 370, the crowd force 375, the handle gravity force 385, the dipper gravity force 390, and the material gravity force 396) can be calculated from the position, speed, torque, and acceleration values of the hoist and crowd actions. In some embodiments, the position, speed, torque, and acceleration values are sensed by the various sensors 220 (e.g., the position sensors, the speed sensors, the accelerometer sensors, and torque sensors) and received by the controller 205. In operation, the hoist force 370 and the crowd force 375 are the only forces which can be manipulated in response to the variations of the other forces, including the dig operation force 380. The hoist force 370 is manipulated by varying the torque of the hoist motors 275. The crowd force 375 is manipulated by varying the torque of the crowd motors 265.

Figure 5:
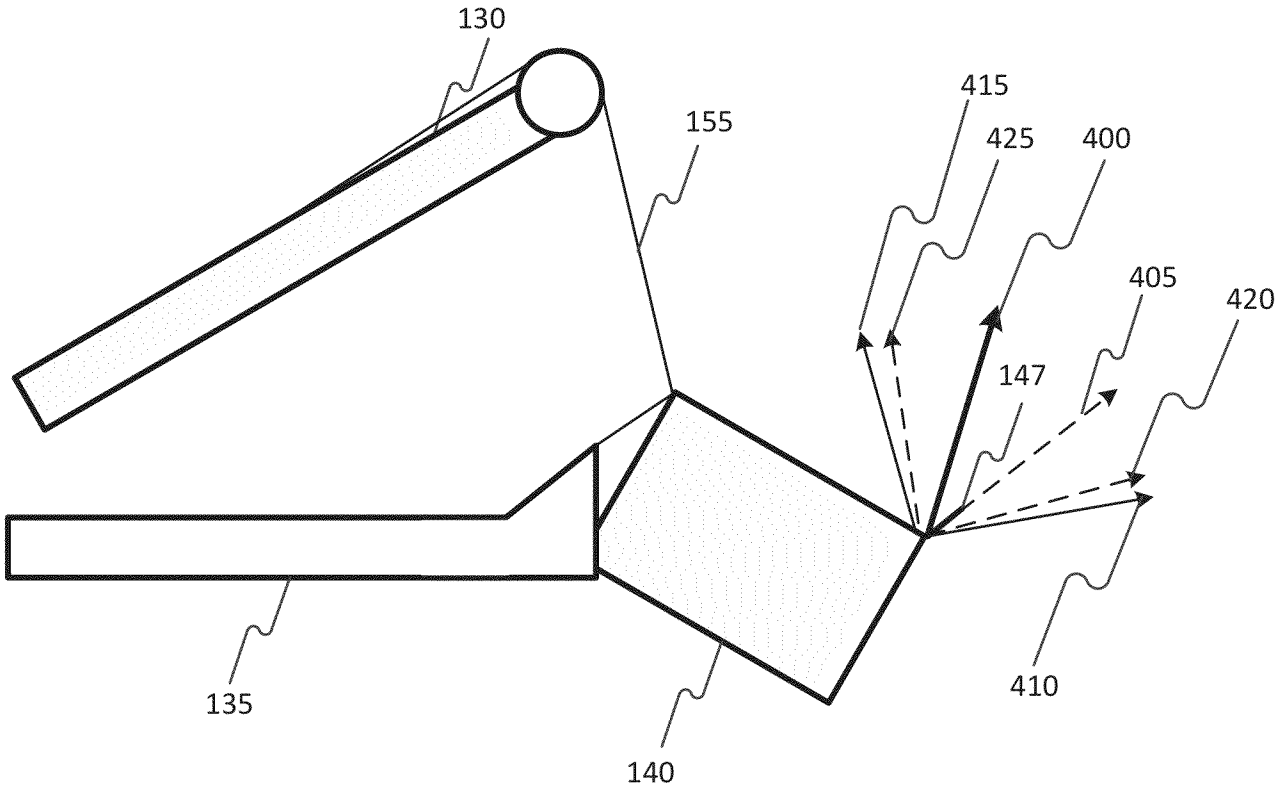
FIG. 5 illustrates a dipper, a handle, and a boom of the mining machine of FIG. 1.

FIG. 5 illustrates a portion of the mining shovel 100 of FIG. 1, including the dipper 140, the handle 135, and the boom 130, according to one embodiment of the invention. As discussed above, the dig force vector 400 comprises a dig force magnitude and a dig force angle. In some embodiments, the dig force magnitude and the dig force angle are controlled based on an engagement point angle as well as the dynamic forces on the attachment. The engagement point, for example but not limited to, can be the dipper teeth 147 or the dipper lip. In the illustrated embodiment, the dig force magnitude and the dig force angle are controlled based on a dipper teeth vector 405 (e.g., an engagement point angle) as well as the dynamic forces calculated by the equations above. The dipper teeth vector 405 is a vector which extends from the dipper teeth 147. In another embodiment, the dig force vector 400 is controlled based on a dipper lip angle as well as the known dynamic forces. When vector control is enabled, the controller 205 limits the dig force magnitude based on the angle of the dig force vector 400 relative to a lower boundary 410 and an upper boundary 415. The dig force magnitude is limited by lowering the torque of the crowd motors 265 and the torque of the hoist motors 275 or controlling an angle of the dipper 140. The dig force angle is changed by lowering or increasing the torque of the crowd motors 265 and the torque of the hoist motors 275 or controlling an angle of the dipper 140. For example, to limit the dig force magnitude while maintaining a dig force angle, the torque of the crowd motors 265 and the torque of the hoist motors 275 are substantially proportionally lowered. To limit the dig force magnitude while changing the dig force angle, or to maintain a dig force magnitude while changing the dig force angle, the torque of the crowd motors 265 and the torque of the hoist motors 275 are lowered or increased disproportionally. In a further example, if the angle of the upper boundary 415, relative to a known point (e.g., the ground), is less than the angle of the hoist cables 155, relative to the same known point, upon the angle of the dig force vector 400 approaching the lower boundary 410, the controller 205 will limit the torque of the crowd motors 265. If the angle of the upper boundary 415 is greater than the angle of the hoist cables 155, then the controller 205 will disproportionally limit the torque of the crowd motors 265 and the hoist motors 275.

In some embodiments, a lower buffer 420 and an upper buffer 425 are used in conjunction with the lower boundary 410 and upper boundary 415. The lower buffer 420 and the upper buffer 425 prevent "over-shooting" of the lower boundary 410 and the upper boundary 415. In such an embodiment, the lower buffer 420 is at a predetermined position between the dipper teeth vector 405 and the lower boundary 410 and the upper buffer 425 is at a predetermined position between the dipper teeth vector 405 and the upper boundary 415. In such an embodiment, once the dig force vector 400 crosses the lower buffer 420 or the upper buffer 425, the dig force magnitude is limited, by decreasing the torque limit of the respective motor 216. In some embodiments, the lower buffer 420 is at the same position as the dipper teeth vector 405. In some embodiments, the predetermined positions of the lower buffer 420 and upper buffer 425 are determined by the response time of the control system 200.

In some embodiments, the lower boundary 410 and the upper boundary 415 are dynamic and change depending on the position and angle of the dipper teeth 147. In another embodiment, the lower boundary 410 and the upper boundary 415 are fixed relative to the dipper teeth 147. In yet another embodiment, the lower boundary 410 is fixed and the upper boundary 415 is dynamic. In yet another embodiment, the lower boundary 410 is dynamic and the upper boundary 415 is fixed. In yet another embodiment, the lower boundary 410 and the upper boundary 415 are relative to each other.

Figure 6:
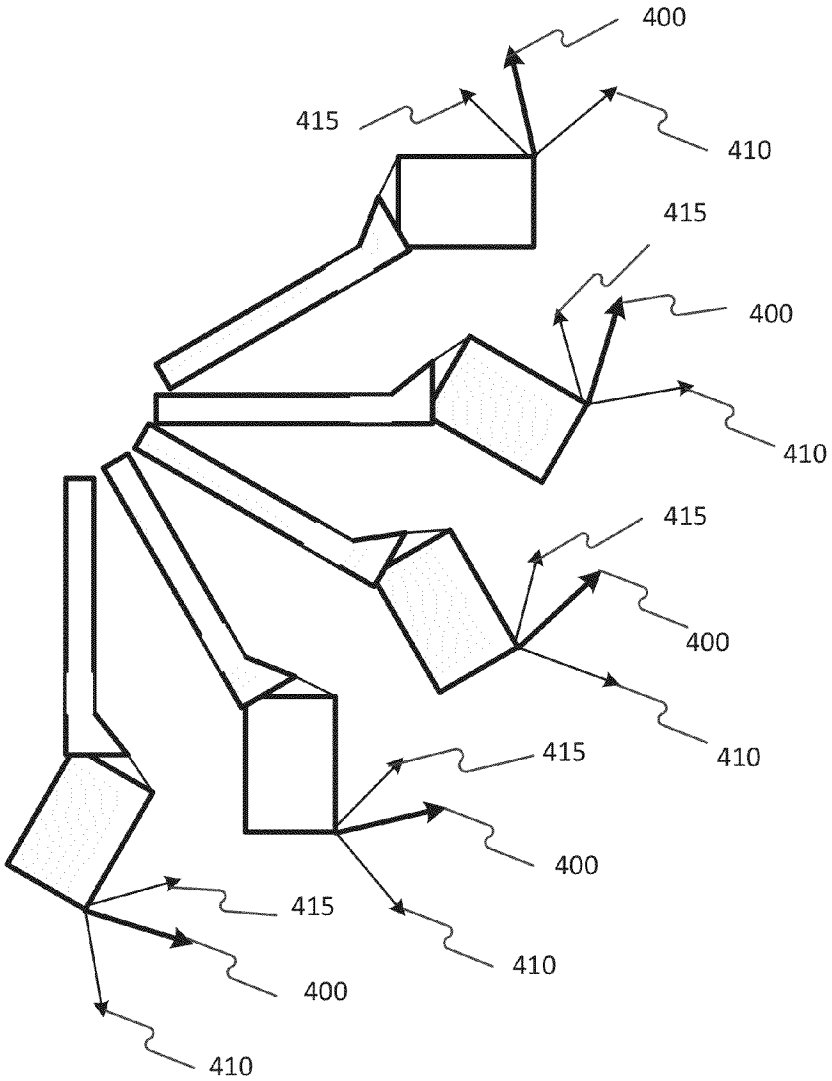
FIG. 6 illustrates the dipper and handle of FIG. 4 in various positions.

FIG. 6 illustrates the lower boundary 410 and upper boundary 415 dynamically changing dependent on the position of the dipper 140, and thus the position of the dipper teeth 147 of FIG. 5. The boundaries change dependent on the position of the dipper 140; therefore the boundaries change dependent on the operation of the mining shovel 100. For example, when the dipper 140 is penetrating a bank of mining material during a dig operation, the lower boundary 410 will be at an angle that reduces boom jacking. Further, when the dipper 140 is cutting up the bank, the lower boundary 410 and upper boundary 415 will change in order to encourage the dig force vector 400 to be slightly less than vertical or in an optimal digging direction. The dig force vector 400 at an angle slightly less than vertical will utilize the hoist power without stalling the hoist motor by crowding the dipper 140 into the bank.

Additionally, vector control is also operable to increase the torque limits of the motors 216. For example, when the dipper 140 is closer to the centerline (swing axis 125) of the mining shovel 100, the torque limits of a plurality of the motors 216 will be increased. This will allow for the dig magnitude to be higher than conventional mining machines with minimal impact to structural components of the mining machine 100.

In some embodiments, vector control is further operable to track where the attachment (e.g., the dipper 140) has been, in order to follow the direction of a digging path and minimize the variation. In such an embodiment, the torque limits of the crowd motors 265 and hoist motors 275, and thus the crowd force 375 and hoist force 370, are adjusted in order to minimize variation of the angle of the dig force vector 400 with respect to the digging path at which the engagement point (e.g., dipper teeth 147, dipper lip, etc.) is traveling.

Thus, the invention provides, among other things, vector control for mining machines. Various features and advantages of the invention are set forth in the following claims.

What is claimed is:

1. A method of controlling a digging operation of an industrial machine, the industrial machine including a dipper, a crowd motor, and a hoist motor, the method comprising:
   - determining a torque associated with the crowd motor and a torque associated with the hoist motor;
   - determining a dig force vector for the dipper based on the torque associated with the crowd motor and the torque associated with the hoist motor, the dig force vector including a dig force angle and a dig force magnitude;
   - determining a value for the dig force angle of the dig force vector; and
   - controlling, using a processor, the dig force magnitude based on the determined value for the dig force angle, the dig force magnitude being controlled by controlling at least one of the torque associated with the crowd motor and the torque associated with the hoist motor.

2. The method of claim 1, wherein the torque associated with the crowd motor is controlled by controlling a breakdown torque of the crowd motor.

3. The method of claim 1, wherein controlling the dig force magnitude includes proportionally controlling the torque associated with the crowd motor and the torque associated with the hoist motor.

4. The method of claim 1, wherein controlling the dig force magnitude includes disproportionally controlling the torque associated with the crowd motor and the torque associated with the hoist motor.

5. The method of claim 1, wherein the at least one of the torque associated with the crowd motor or the torque associated with the hoist motor is varied between a minimum torque value corresponding to a first dig force angle boundary and a maximum torque value corresponding to a second dig force angle boundary.

6. The method of claim 5, further comprising modifying the first dig force angle boundary or the second dig force angle boundary based on a characteristic of the industrial machine.

7. The method of claim 6, wherein the characteristic of the industrial machine is a position of the dipper.

8. The method of claim 6, wherein the characteristic of the industrial machine is a force exerted on the dipper.

9. The method of claim 6, wherein the characteristic of the industrial machine is an operator reference.

10. The method of claim 5, further comprising increasing the minimum torque value when the dipper approaches a bank.

11. The method of claim 10, further comprising reducing the maximum torque value when the dipper traverses up the bank.

12. An industrial machine comprising:
   - a dipper;
   - a crowd drive configured to provide one or more control signals to a crowd motor, the crowd motor operable to provide a force to the dipper to move the dipper;
   - a hoist drive configured to provide one or more control signals to a hoist motor, the hoist motor operable to provide a force to the dipper to move the dipper; and
   - a controller including a processor and connected to the crowd drive and the hoist drive, the controller configured to:
     - determine a torque of the crowd motor and a torque of the hoist motor;
     - determine a dig force vector for the dipper based on the torque of the crowd motor and the torque of the hoist motor, the dig force vector including a dig force angle and a dig force magnitude;
     - determine a value for the dig force angle of the dig force vector; and
     - control the dig force magnitude based on the determined value for the dig force angle, the dig force magnitude being controlled by controlling at least one of a torque of the crowd motor and a torque of the hoist motor.

13. The industrial machine of claim 12, wherein the torque associated with the crowd motor is controlled by controlling a breakdown torque of the crowd motor.

14. The industrial machine of claim 12, wherein controlling the dig force magnitude includes proportionally controlling the torque of the crowd motor and the torque of the hoist motor.

15. The industrial machine of claim 12, wherein controlling the dig force magnitude includes disproportionally controlling the torque of the crowd motor and the torque of the hoist motor.

16. The industrial machine of claim 12, wherein the torque of the crowd motor or the torque of the hoist motor is varied between a minimum torque value corresponding to a first dig force angle boundary and a maximum torque value corresponding to a second dig force angle boundary.

17. The industrial machine of claim 16, further comprising modifying the first dig force angle boundary or the second dig force angle boundary based on a characteristic of the industrial machine.

18. The industrial machine of claim 17, wherein the characteristic of the industrial machine is selected from the group consisting of a position of the dipper, a force exerted on the dipper, or an operator reference.

19. A method of controlling a digging operation of an industrial machine, the industrial machine including a dipper, a crowd actuator, and a hoist actuator, the method comprising:
   - determining a force associated with the crowd actuator and a force associated with the hoist actuator;
   - determining a dig force vector for the dipper based on the force associated with the crowd actuator and the force associated with the hoist actuator, the dig force vector including a dig force angle and a dig force magnitude;
   - determining a characteristic of the industrial machine; and
   - controlling, using a processor, the dig force vector based on the characteristic of the industrial machine, the dig force vector being controlled by controlling at least one of the force associated with the crowd actuator, the force associated with the hoist actuator, and an angle of the dipper.

20. The method of claim 19, wherein the characteristic of the industrial machine is a net force acting on the dipper.

21. The method of claim 19, wherein the characteristic of the industrial machine is a position of the dipper.

22. The method of claim 21, wherein the position of the dipper corresponds to a position of a point on the dipper.

23. The method of claim 22, wherein the point on the dipper is a point at which the dipper engages a bank.

* * * * *